United States Patent [19]

Asano et al.

[11] 3,986,595

[45] Oct. 19, 1976

[54] ESCALATOR

[75] Inventors: Masaru Asano; Teruo Kamioka, both of Inazawa, Japan

[73] Assignee: Mitsubishi Denki Kabushiki Kaisha, Japan

[22] Filed: June 20, 1975

[21] Appl. No.: 588,721

[30] Foreign Application Priority Data

June 21, 1974 Japan ..... 49-71622

[52] U.S. Cl. ..... 198/333; 104/25

[51] Int. Cl.[2] ..... B66B 9/12

[58] Field of Search ..... 198/16, 16 MS, 17, 18, 198/110, 232, 1; 104/25

[56] References Cited

UNITED STATES PATENTS

| | | | |
|---|---|---|---|
| 2,080,980 | 5/1937 | Fiedler | 198/16 R |
| 2,210,711 | 8/1940 | Dunlop | 198/16 R |
| 2,813,613 | 11/1957 | Marcles | 198/16 R |

FOREIGN PATENTS OR APPLICATIONS

| | | | |
|---|---|---|---|
| 1,039,010 | 8/1966 | Canada | 198/16 MS |

*Primary Examiner*—Evon C. Blunk
*Assistant Examiner*—Douglas D. Watts
*Attorney, Agent, or Firm*—Robert E. Burns; Emmanuel J. Lobato; Bruce L. Adams

[57] ABSTRACT

The disclosed safety devices are disposed at either of the edges of each stair of an escalator. Each device includes a sensor dovetailed to a bracket for the individual stair treads and risers to abut against and be horizontally aligned with a displacement element screwed to the bracket. The sensor of each device projects beyond a corresponding riser. If a passenger's calf or the like contacts the sensor, the latter retrogrades to displace the abutting end portion of the displacement element toward the adjacent skirt plate of the escalator to narrow a space formed between the displacement element and the skirt plate. The sensor may be disposed in a vertically aligned, abutting relationship upon the displacement element to somewhat project beyond the cleats on a tread.

10 Claims, 7 Drawing Figures

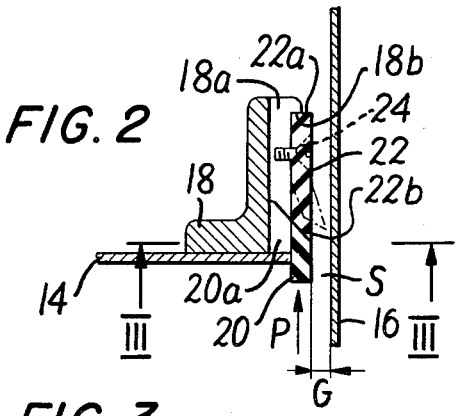
FIG. 2
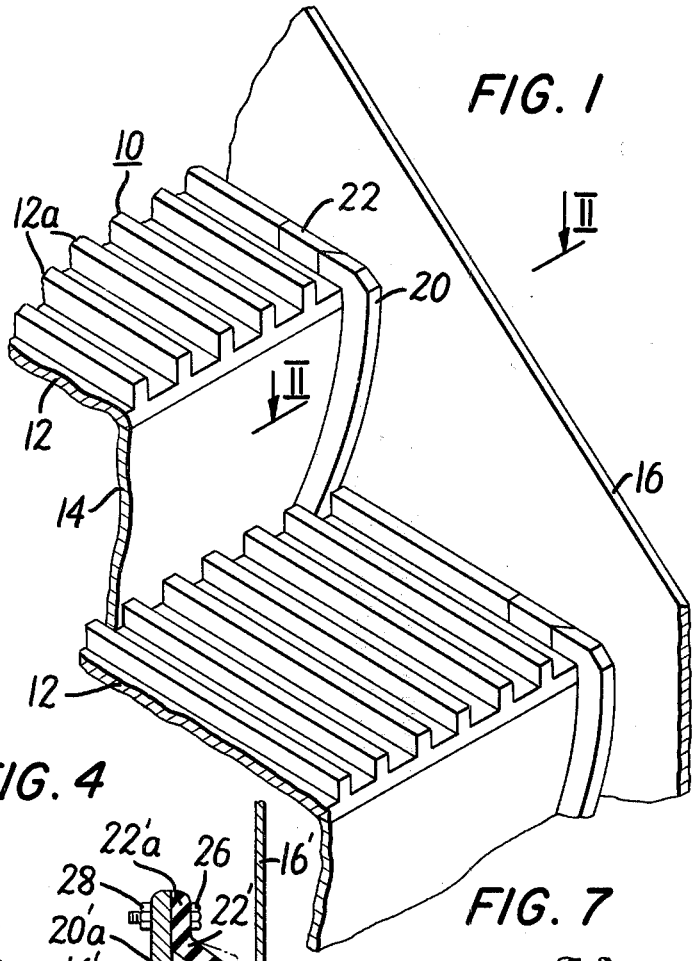
FIG. 1
FIG. 3
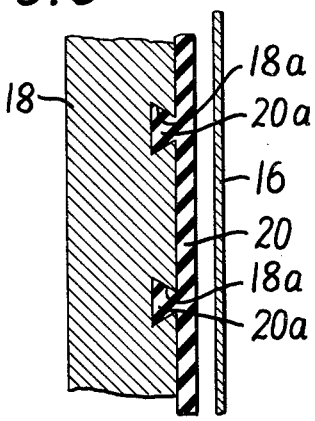
FIG. 4
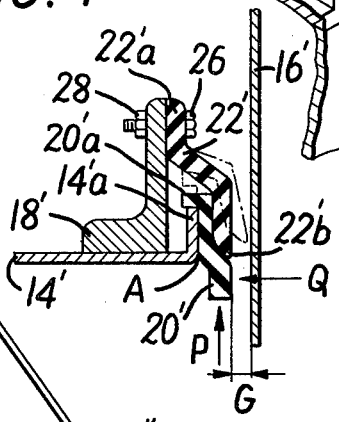
FIG. 7
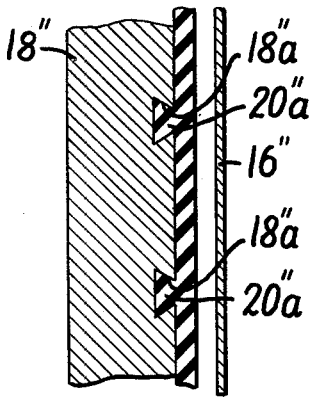
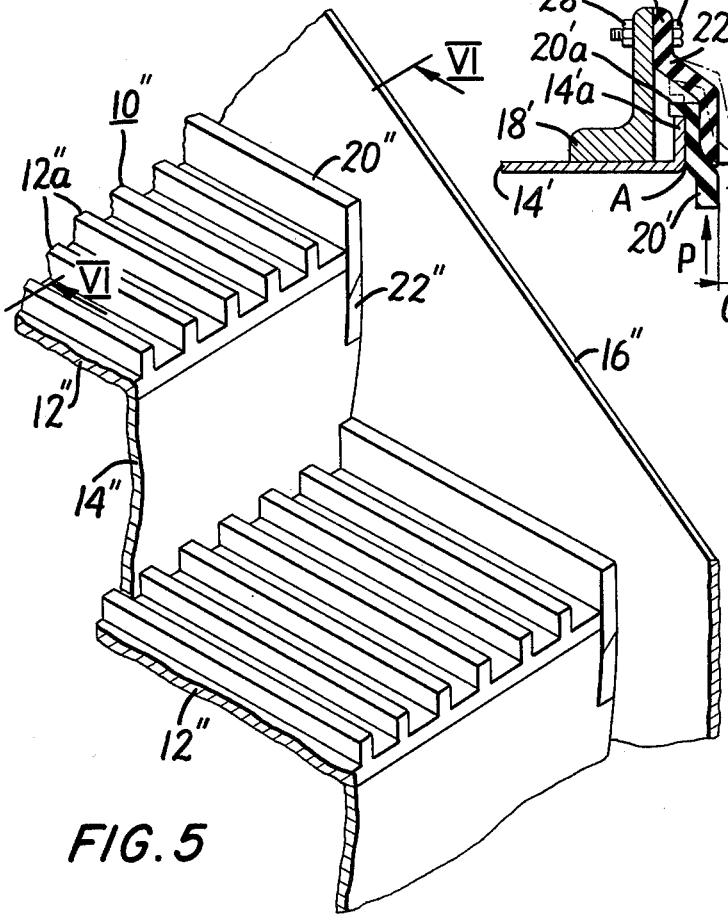
FIG. 5
FIG. 6
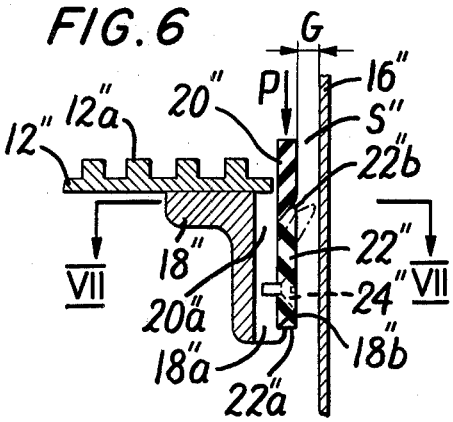

ESCALATOR

BACKGROUND OF THE INVENTION

This invention relates to an escalator system and more particularly to a safety device for an escalator system.

It is well known that escalator systems comprise a pair of opposite skirt plates forming the lower balustrade portions and the staircase formed of a plurality of stairs disposed and traveling in contiguous relationship along and between the skirt plates. Since the skirt plates are stationary and the staircase is a moving body, a gap in the order of several millimeters is provided between each of the lateral edges of the staircase and the adjacent skirt plate in order to prevent the two from contacting each other. The provision of such a gap makes some passengers fear that, if the passenger accidentally approaches either of the gaps that his or her shoe or calf or one portion of his or her clothes will be caught in the approaching gap. More specifically, the staircase is generally formed of a plurality of tread boards on which a passenger or passengers may ride and one riser covering a rise portion located between each pair of adjacent tread boards. During the downward movement of the staircase the contacting of a passengers calf or the like with either of the skirt plates causes the calf or the like to be spatially stationary due to friction developed therebetween. This leads to fear that the spatially stationary calf or the like will be caught in the gap between the adjacent skirt plate and that riser located behind the calf or the like due to the advance of the riser. Similarly during the upward movement of the staircase, a passenger's shoe or like may be taken into the gap between the adjacent skirt plate and that tread board located below the show or the like.

Various countermeasures have been previously made to such an accident. For example, either of the lateral edges of each tread board has been painted yellow in a width of several centimeters for a danger indication. Alternatively that cleat disposed at either of the lateral edges of each of the cleated tread boards has been higher than the remaining cleats thereon to play a role resembling that of a screen thereby to prevent a toe of a passenger's shoe or the like from directly contacting the gap as above described. To paint the lateral edges of each tread board has relied on the mental process of passengers and therefore been ineffective as to those passengers disregarding that warning. In addition, the paint has peeled away within a short time interval resulting in the damage to the appearance. Re-painting has required much labor and a long time. The provision of the higher cleat on the tread board has been ineffective for passengers riding on the tread boards with one foot thereof somewhat kept lifted. Thus the countermeasures as above described have lacked reliability.

SUMMARY OF THE INVENTION

Accordingly it is an object of the present invention to provide a new and improved escalator system including a safety device ensuring that a gap between either of the lateral edges of each tread board and the adjacent skirt plate is prevented from gripping or catching any body, for example, a passenger's foot or like.

The present invention provides a safety device for an escalator system comprising a pair of opposite skirt plates and a plurality of stairs disposed in contiguous relationship along and between the skirt plates, each of the stairs including a main body formed of a tread board provided with a plurality of cleats and a riser, the plurality of stairs traveling with a gap formed between each of the lateral edges of each tread board and the adjacent skirt plate. The safety device includes a sensor element disposed at either of the lateral edges of the main stair body to be moved through the contacting thereof with a body, and a displacement element located in a path of movement of the sensor element to be displaced in a direction to narrow the gap in response to the movement of the sensor element.

BRIEF DESCRIPTION OF THE DRAWINGS

The present invention will become more readily apparent from the following detailed description taken in conjunction with the accompanying drawings in which:

FIG. 1 is a fragmental perspective view of an escalator embodying the principles of the present invention with parts broken away;

FIG. 2 is a cross sectional view as taken along the line II—II of FIG. 1;

FIG. 3 is a sectional view as taken along the line III—III of FIG. 2;

FIG. 4 is a view of similar to FIG. 2 but illustrating a modification of the present invention;

FIG. 5 is a view similar to FIG. 1 but illustrating another modification of the present invention;

FIG. 6 is a cross sectional view as taken along the line VI—VI of FIG. 5; and FIG. 7 is a sectional view taken along the line VII—VII of FIG. 6.

Throughout the Figures like reference numerals designate the identical or corresponding components.

DESCRIPTION OF THE PREFERRED EMBODIMENTS

Referring now to the drawings and FIG. 1 in particular, there is illustrated one portion of an escalator apparatus embodying the principles of the present invention. The arrangement illustrated comprises a plurality of stairs disposed to be adjacent to one another to form a staircase. Each of the stairs includes the main body generally designated by the reference numeral 10 and including a tread board 12 and a riser 14 covering a rise portion located between the tread board 12 and the adjacent one 12. Then the staircase is disposed along and between a pair of opposite skirt plates 16 (only one of which is partly illustrated) each forming a lower portion of a ballustrade of the escalator apparatus and spaced away from the adjacent lateral edge of the main stair body 10 by a gap of several millimeters. The skirt plate 16 is generally of sheet stainless steel or the like smooth on both surfaces. The staircase is adapted to be moved along and between the opposite skirt plates 16 and the tread board 12 is provided on the upper surface as viewed in FIG. 1 with a plurality of cleats **12*a*** running in spaced parallel relationship and in a direction of movement of the staircase.

As best shown in FIG. 2, the main stair body 10 further includes, as the main rib, a bracket 18 of L-shaped cross section disposed so as to have one leg substantially perpendicular to the skirt plate 16 and the other leg substantially parallel to the latter. The bracket 18 has the one leg attached to the riser 14 and the other leg provided on that surface opposite to the adjacent skirt plate 16 with a plurality of spaced dovetail grooves **18*a* running in parallel to the adjacent skirt plate 16 and also to the upper surface of the tread board 12 (see FIG. 3). The other leg of the bracket 18 has also a step 18***b* disposed at the rear or free ends thereof to protrude toward the adjacent skirt plate 16. The term "rear end" or "rear side" used herein and in the claims means that end or side of any element or member remote away from the viewer in FIG. 1. Accordingly that end or side of the element or member near to the viewer in FIG. 1 refers to a "front end" or "front side".

As shown in FIG. 2, a sensor element 20 is attached to the other leg of the bracket 18 by having a plurality of dovetail ridges 20*a* complentary in cross section to and fitted into the grooves 18*a* on the bracket 18. The sensor element 20 is disposed in contact relationship with either of the lateral edges of the riser 14 for movement in front and rear of the main stair body 10 but against movement in the vertical and lateral directions thereof due to the dovetailing as above described. The terms "vertical and lateral directions" are the corresponding directions as viewed in FIG. 1. The sensor element 20 somewhat projects beyond the riser 14.

Then a displacement element 22 substantially equal in thickness to the sensor element 20 is fixedly secured to the other leg of the bracket 18 through counter-sunk screws 24 (only one of which is illustrated in FIG. 2) so as to be disposed in contact with the lateral edge of the riser 14 and abut against the sensor element 20. More specifically, the displacement element 22 is engaged at the rear end 22*a* by the step 18*b* on the sensor element 20, and at the front end 22*a* by the rear end of the sensor element 20. The engaging portions of both elements 20 and 22 are in the form of wedges so that the wedge of the sensor element 20 has a sloped surface tapered toward the rear end thereof contacting a complementary, sloped surface formed on the wedge of the displacement element 22, the latter surface being tapered toward the front end thereof. Thus the sensor element 20 is horizontally aligned with the displacement element 22.

Further the grooves 18*a* on the bracket 18 have front openings closed with the riser 14 thereby to prevent the ridges 20*a* on the displacement element 22 from disengaging from the associated grooves 18*a* on the bracket 18.

It is to be understood that the sensor and displacement elements 20 and 22 respectively are also disposed at that lateral edge not shown in FIG. 1 of the main stair body 10 in the same manner as above described and that each of the other main stair bodies has disposed at either of the lateral edges thereof a sensor and a displacement element identical to those above described.

In the arrangement as shown in FIGS. 1, 2 and 3, it is assumed that a passenger on the tread board 12 has his or her calf contacting the adjacent portion of the skirt plate 16. This results in the calf entering into a gap G formed between the sensor element 20 and the mating skirt plate 16 (see FIG. 2). When any body invades the gap G, the body inevitably contacts the sensor element 20 to exert a pushing force (see the arrow P shown FIG. 2) upon the sensor element 20 tending to force the body into the gap G. This causes the ridge 20*a* on the sensor element 20 to be moved within the respective grooves 18*a* on the bracket 18 resulting in the retrogression of the sensor element 20. This retrogression of the sensor element 20 permits a force to be applied to the displacement element 22 tending to move the latter rearwardly. Since the sensor and displacement elements 20 and 22 respectively have the individual wedges contacting each other as above described, the front end 22*b* of the displacement element 22 is displaced toward the adjacent skirt plate 16 by means of the action of a component force resulting from the wedge action. The displaced front end 22*b* is shown at dotted and dashed line in FIG. 2. This displacement of the front end 22*b* minimizes the gap G resulting in an absence of room to permit a body to enter the gap G thus narrowed. At the same time, the gap G minimized in width serves to disengage the body such as the calf of a passenger in intimate contact with the skirt plate 16 from the latter. In that event the slope of the front end 22*b* of the displacement element 22 is extremely effective for scooping up the body.

In order to minimize the depth to which a body may enter the gap G, the front end 22*b* of the displacement element 22 is preferably located adjacent an opening S (see FIG. 2) between the sensor element 20 and the adjacent skirt plate 16. If desired, the front end 22*b* may be outside of the opening S.

The sensor and displacement elements 20 and 22 respectively are adapted to slide along each other as do the grooves 18*a* and the ridges 20*a*. Also the displacement or deformation of the front end 22*b* of the displacement element 22 to its position as illustrated at dotted and dashed line in FIG. 2 may contact the displaced front end 22*b* with the adjacent skirt plate 16. Therefore the sensor and displacement elements 20 and 22 respectively are preferably of a synthetic resin enriched in both self-lubrication and wear proof. In addition, the displacement element 22 should be readily deformed or displaced in response to a pushing force applied thereto and able to return back to its original state or position after the release of the pushing force. Further the displacement element 22 must have a hardness sufficient to scoope up a body taken into the gap G. For these reasons, the displacement element 22 is preferably of a resilient, semi-hard material.

FIG. 4 shows a modification of the arrangement as shown in FIGS. 1, 2 and 3 wherein the parts corresponding to the first embodiment have the reference numerals similar thereto primed and wherein the displacement element 22' is responsive not only to a pushing force applied to the sensor element 20' at the front end but also to a pushing force laterally applied to the latter to be deformed or displaced as desired. As shown in FIG. 4, that end portion 14'*a* of the riser 14' near to the skirt plate 16' is bent toward the rear end of the other leg of the L-shaped bracket 18' to form a gap therebetween. Then the sensor element 20' has a rear portion disposed on the bent end portion 14'*a* of the riser 14' by having its rear hooked end engaging the extremity of the bent riser end portion 14'*a* and also any suitable means (not shown) for preventing the element 20' from falling in the downward direction or in the direction biased by gravity. The rear portion of the sensor element 20' is integrally connected to a front portion thereof through an intermediate portion tilted toward the skirt plate 16'. The front portion of the sensor element 20' projects beyond the riser 14'.

The displacement element 22' is of nearly Z-shaped cross section formed of any suitable resilient, semi-hard material and includes a rear portion 22'*a* fastened to the other leg of the bracket 18' through bolts 26 and nuts 28, and a front portion 22'*b* integrally connected to the rear portion 22'*a* through an intermediate portion sloped toward the skirt plate 16' so that the sensor element 20' is sandwiched between the bent riser end portion 14'a and the front portion 22'b of the displacement element 22.

If a pushing force (see FIG. 4) is applied to the sensor element 20' at the front end as shown at the arrow P in FIG. 4 then the sensor element 20' retrogrades until its rear end 20'a is moved to its position illustrated at dotted and dashed line in FIG. 4. This pushes the intermediate sloped portion of the displacement element 22' to deform or displace the element 22' as shown at dotted and dashed line in FIG. 4. As a result, the deformed or displaced element 22' narrows the gap G as in the arrangement as shown in FIGS. 1, 2 and 3.

With a pushing force laterally applied to the sensor element as shown at the arrow Q in FIG. 4, the rear portion 20'a of the sensor element 20' is turned toward the skirt plate 16' about its fulcrum A formed at the bent corner of the riser 14'. This turning movement of the sensor element 20' gives the same result as above described in conjunction with the pushing force P.

If a body is partly taken into the gap G to locally push the sensor element 20' then the front displacement of the end 22b becomes large in displacement proportionally to the particular pushing force. Thus that portion of the gap G where a danger is the greatest is most reduced in width.

Referring now to FIGS. 5, 6 and 7, there is illustrated a modification of the present invention wherein the parts corresponding to the parts similar to the other embodiments have similar reference numerals but which are double primed. In the arrangement illustrated, the L-shaped bracket 18'' has one leg to which the tread board 12'' is fixedly secured and the other leg extending downwardly or toward the next lower tread board. Then the other bracket leg is operatively connected to the sensor and displacement elements 20'' and 22'' in the manner as shown in FIGS. 6 and 7. That is, the connection of both elements to the bracket 18'' identical to that above described in conjunction with FIGS. 1, 2 and 3 except for the position of the sensor element relative to the displacement element. Namely the sensor element 20'' is disposed upon the displacement element 22'' and more projects from the surface of the tread board 12'' than the cleats 12''a on the latter. Thus the sensor element 20'' abuts in vertically aligned relationship against the displacement element 22''.

In the arrangement as shown in FIGS. 5, 6 and 7 it is to be understood that the sensor element 20'' is permitted to be moved in the vertical direction but prevented from being moving in the forward and rearward directions and the lateral direction. In this case, the terms "vertical", forward, "rearward" and "lateral" refer to FIG. 5 and are the same in meaning as previously described in conjunction with FIG. 1.

In summary, the present invention provides a safety device comprising a sensor element disposed at either of lateral edges of each main stair body to be movable with respect thereto and a displacement element in response to the movement of the sensor element to be displaced or deformed. The sensor element is operative to sense the movement of any body tending to be caught in a gap formed between the main stair body and the adjacent skirt plate to cause the displacement element to narrow the gap before the body is bitten into the gap. In addition the displacement element is operative to scoope up the body put in intimate contact with the skirt plate. The safety device ensures that serious dangers such as the intrusion of a passenger's foot into the gap are prevented from occurring.

While the present invention has been illustrated and described in conjunction with a few preferred embodiments thereof it is to be understood that numerous changes and modifications may be resorted to without departing from the spirit and scope of the present invention. For example, the arrangement of FIG. 4 may be applied to the arrangement as shown in FIGS. 5, 6 and 7. The sensor and displacement elements may be formed into a unitary structure as long as the unitary structure have both the function of the sensor element and that of the displacement element. Also both the sensor and displacement elements may be painted with a vivid color different from a color applied to the main stair body, for example with yellow color. This results in a danger indication resorting to the visual sensation of passengers which is higher in security.

What we claim is:

1. An escalator system comprising, a travelling stairway having a plurality of main stair bodies disposed and travelling along adjacent a skirt plate defining a gap between the lateral edge of each of the main stair bodies and said skirt plate, each body of said main stair comprising one tread board including a plurality of cleats and one riser, for each body a safety device including a sensor element disposed on a lateral edge of each of said main stair body movable by contact with an object, and a displacement element located in a path of movement of said sensor element to respond to the movement of said sensor element and displaced in response to said movement in a direction to narrow said gap.

2. An escalator system as claimed in claim 1 wherein said safety device is made of a self lubricated material.

3. An escalator system as claimed in claim 1 wherein said safety device is made of a material different in color from that of each said main stair body.

4. An escalator system as claimed in claim 1 wherein said sensor element of said safety device projects beyond said main stair body.

5. An escalator system as claimed in claim 1 wherein said sensor element of said safety device abuts against said displacement element, and abutting portions on said sensor and said displacement element in the form of wedges including respective sloped surfaces contacting each other.

6. An escalator system as claimed in claim 1 wherein said sensor element of said safety device is disposed sandwiched between said lateral edge of said main stair body and said displacement element fixedly secured to said lateral edge to be moved in response to a selected one of forces applied to said sensor element from the front and lateral sides respectively.

7. An escalator system as claimed in claim 1 wherein said safety device is disposed at a lateral edge of said riser.

8. An escalator system as claimed in claim 1 wherein said safety device is disposed at a lateral edge of said tread board.

9. An escalator system as claimed in claim 7 wherein said sensor element of said safety device is mounted movable in forward and rearward directions of said main stair body but prevented from being moved in the vertical and lateral directions of said main stair body.

10. An escalator system as claimed in claim 8 wherein said sensor element of said safety device is mounted movable in the vertical direction of said main stair body but prevented from being moved in the forward, rearward, and lateral directions of said main stair body.

* * * * *